US012092436B2

(12) United States Patent
Melkers et al.

(10) Patent No.: US 12,092,436 B2
(45) Date of Patent: Sep. 17, 2024

(54) CONTROL SURFACE RESTRAINING SYSTEM FOR TACTICAL FLIGHT VEHICLES

(71) Applicant: Raytheon Company, Waltham, MA (US)

(72) Inventors: Edgar R. Melkers, Tucson, AZ (US); Kenyon Kehl, Tucson, AZ (US); Andre White, El Dorado Hills, CA (US); Gregory A. Trainor, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 480 days.

(21) Appl. No.: 17/466,210

(22) Filed: Sep. 3, 2021

(65) Prior Publication Data

US 2023/0072799 A1 Mar. 9, 2023

(51) Int. Cl.
*F42B 10/64* (2006.01)
*F42B 15/01* (2006.01)

(52) U.S. Cl.
CPC ..... *F42B 10/64* (2013.01); *F42B 15/01* (2013.01)

(58) Field of Classification Search
CPC ..... F42B 10/14; F42B 10/64
See application file for complete search history.

(56) References Cited

U.S. PATENT DOCUMENTS 3,563,466 A 2/1971 Clark et al.
4,709,877 A * 12/1987 Goulding ..... F42B 10/64 244/3.28
5,409,185 A * 4/1995 Oldakowski ..... F42B 10/64 244/75.1
5,439,188 A * 8/1995 Depew, Jr. ..... F42B 10/64 244/3.21

(Continued)

FOREIGN PATENT DOCUMENTS

DE 3717688 C1 * 5/1987
SE 519764 C2 * 4/2003 ..... F42B 10/14

OTHER PUBLICATIONS

The pending claims of co-pending U.S. Appl. No. 17/829,799, filed Jun. 1, 2022.

*Primary Examiner* — Magdalena Topolski
(74) *Attorney, Agent, or Firm* — Schwegman Lundberg & Woessner, P.A.

(57) ABSTRACT

A control surface restraining system for variably restraining a control surface on a flight vehicle includes a passively triggered and manually movable control surface restraint for keeping the control surface aligned along a longitudinal axis of the flight vehicle, while allowing for temporary control surface rotation during handling and loading. The control surface restraining system allows the control surfaces to be manually rotated out of and back to the "zero position" (i.e., aligned along the longitudinal axis) for loading the flight vehicle with a common load strap, and thereafter maintained in the "zero position" until launch for proper control actua- (Continued)

tion system initialization. Upon launch, the control surface restraining system is passively actuated for releasing the control surface, requiring no active stimulus from the guidance section, power, or associated wiring, therefore saving critical space and volume within the tactical flight vehicle.

20 Claims, 3 Drawing Sheets

(56) References Cited

U.S. PATENT DOCUMENTS

| | | | | |
|---|---|---|---|---|
| 5,685,503 | A * | 11/1997 | Trouillot | F42B 10/14 244/3.28 |
| 5,950,963 | A * | 9/1999 | Speicher | F42B 10/64 244/3.21 |
| 6,352,217 | B1 * | 3/2002 | Hsu | F42B 10/64 244/49 |
| 6,450,444 | B1 * | 9/2002 | Sorvino | F42B 10/64 244/3.24 |
| 7,246,539 | B2 * | 7/2007 | Turner | F42B 10/64 244/225 |
| 7,316,370 | B2 | 1/2008 | Sankovic et al. | |
| 8,278,612 | B2 * | 10/2012 | Firor | F42B 10/14 244/3.28 |
| 8,686,328 | B2 | 4/2014 | Bugge et al. | |
| 10,295,318 | B2 * | 5/2019 | Hammond | F42B 10/14 |
| 10,655,665 | B2 | 5/2020 | Balsells | |
| 11,530,905 | B2 * | 12/2022 | Seward | F42B 10/14 |
| 2023/0400285 | A1 * | 12/2023 | Dixon | F42B 10/00 |

* cited by examiner

CONTROL SURFACE RESTRAINING SYSTEM FOR TACTICAL FLIGHT VEHICLES

TECHNICAL FIELD

The present disclosure relates generally to tactical flight vehicles and more particularly to control surface restraining systems for tactical flight vehicles.

BACKGROUND

Tactical flight vehicles, such as missiles and rockets, often have one or more control surfaces, such as tail fins, elevators, ailerons, elevons, rudders, flaps, slats, etc. Such control surfaces are mounted to the tactical flight vehicle and controlled by a control actuation system for controlling a flight path of the tactical flight vehicle. Tactical flight vehicles that are, for example, launched from environments having vibratory influences, have adjacent flight vehicle launches, or are air-launched typically require a control surface restraint to keep the control surfaces aligned along the longitudinal axis. Such alignment is important for adjacent storage clearance, lower drag on the carrying aircraft, and to keep the control fins aligned at a "zero position" for calibration of a control actuation system before initialization. Additionally, in order to load the tactical flight vehicle into the carrying aircraft, the control surfaces must be able to be rotated to make room for a loading strap to wrap around the tactical flight vehicle for handling. After loading the tactical flight vehicle into the carrying aircraft, the control surfaces must be able to be rotated back and held constant at the "zero position" for proper control actuation system initialization.

Prior attempts to provide such a control surface restraint have involved actively actuated mechanisms that require power and wiring, thus requiring extra internal storage space in order to implement their functionality. These prior attempts have also failed to allow for manual control surface rotation during handling and loading, instead requiring specialized load straps and negating the ability to use a common load strap.

SUMMARY

To solve the aforementioned problems, a control surface restraining system for variably restraining a control surface on a flight vehicle includes a passively triggered and manually movable control surface restraint for keeping the control surface aligned along a longitudinal axis of the flight vehicle, while allowing for temporary control surface rotation during handling and loading of the tactical flight vehicle. The control surface restraining system allows the control surfaces to be manually rotated out of and back to the "zero position" (i.e., aligned along the longitudinal axis) for loading the flight vehicle with a common load strap, and thereafter maintained in the "zero position" until launch for proper control actuation system initialization. Upon launch, the control surface restraining system is passively actuated for releasing the control surface, requiring no active stimulus from the guidance section, power, or associated wiring, therefore saving critical space and volume within the tactical flight vehicle.

According to an aspect of this disclosure, a control surface restraining system for restraining a control surface on a tactical flight vehicle includes a passively triggered actuator movable between an un-triggered position and a triggered position, and a control surface restraint movable between an engaged position and a disengaged position. The control surface restraint is biased in the engaged position. The control surface restraining system also includes a disengagement assembly configured to automatically move the control surface restraint from the engaged position to the disengaged position when the passively triggered actuator is moved from the un-triggered position to the triggered position.

According to an embodiment of any paragraph(s) of this summary, the disengagement assembly includes a mounting ring rotatable around a longitudinal axis of the tactical flight vehicle between a first position and a second position and a rotation lock fixed to and movable by the passively triggered actuator. The rotation lock is movable between a locked position in which the rotation lock is configured to be engaged with the mounting ring, and an unlocked position in which the rotation lock is configured to be disengaged with the mounting ring. The rotation lock is configured to hold the mounting ring in the first position when the rotation lock is in the locked position. The disengagement assembly also includes a mounting ring biasing member at least partially mounted on the mounting ring and configured to bias the mounting ring toward the second position such that the mounting ring is configured to rotate from the first position to the second position when the rotation lock is in the unlocked position.

According to an embodiment of any paragraph(s) of this summary, the control surface restraint includes a control surface engagement portion configured to engage an edge of the control surface when the control surface restraint is in the engaged position, and a control surface restraining portion fixed to the control surface engagement portion and configured to interact with the disengagement assembly to move the control surface restraint from the engaged position to the disengaged position.

According to an embodiment of any paragraph(s) of this summary, the control surface restraining portion includes a control surface support bar configured to support the control surface engagement portion, and a disengagement abutment bar configured to interact with the disengagement assembly.

According to an embodiment of any paragraph(s) of this summary, the mounting ring of the disengagement assembly includes an inclined portion and the disengagement abutment bar of the control surface restraining portion is configured to abut and slide against the inclined portion of the mounting ring as the mounting ring rotates from the first position to the second position, causing the control surface restraint to automatically move from the engaged position to the disengaged position.

According to an embodiment of any paragraph(s) of this summary, the inclined portion of the mounting ring includes a disengagement locking notch into which the disengagement abutment bar of the control surface restraining portion is configured to fit when the disengagement abutment bar slides up the inclined portion.

According to an embodiment of any paragraph(s) of this summary, the control surface engagement portion includes a notch configured to engage the edge of the control surface.

According to an embodiment of any paragraph(s) of this summary, the control surface engagement portion includes a pin configured to fit into a pinhole in an edge of a missile fin.

According to an embodiment of any paragraph(s) of this summary, the passively triggered actuator is a tab extending into an exhaust stream of the tactical flight vehicle, and the passively triggered actuator is moved from the un-triggered position to the triggered position with a force of the exhaust stream According to an embodiment of any paragraph(s) of this summary, the passively triggered actuator is a disk, the control surface restraint is a notch in the disk, and the disengagement assembly is a pivoting mount with which the passively triggered actuator is mounted to the tactical flight vehicle. The passively triggered actuator is moved from the un-triggered position to the triggered position with a force of inertia of the tactical flight vehicle upon launch.

According to an embodiment of any paragraph(s) of this summary, the control surface restraint includes a restraining biasing member configured to bias the control surface restraint in the engaged position.

According to an embodiment of any paragraph(s) of this summary, the control surface restraint is configured to be manually movable from the engaged position to the disengaged position when the passively triggered actuator is in the un-triggered position.

According to an embodiment of any paragraph(s) of this summary, the control surface restraining system further includes a cover configured to house at least part of the control surface restraint and the disengagement assembly.

According to another aspect of this disclosure, a tactical flight vehicle includes an airframe extending along a longitudinal axis and at least one control surface mounted to an aft end of the airframe. The tactical flight vehicle includes at least one control surface restraining system for restraining the at least one control surface on the tactical flight vehicle. The at least one control surface restraining system includes a passively triggered actuator movable between an un-triggered position and a triggered position, and a control surface restraint movable between an engaged position and a disengaged position. The control surface restraint is biased in the engaged position. The control surface restraining system also includes a disengagement assembly configured to automatically move the control surface restraint from the engaged position to the disengaged position when the passively triggered actuator is moved from the un-triggered position to the triggered position.

According to another aspect of this disclosure, a method of variably restraining a control surface on a tactical flight vehicle includes the step of restraining the control surface with a control surface restraint. The control surface restraint is movable between an engaged position and a disengaged position. The method also includes the step of triggering a passively triggered actuator such that the passively triggered actuator is moved from an un-triggered position to a triggered position. The method also includes the step of automatically moving the control surface restraint from the engaged position to the disengaged position upon the triggering of the passively triggered actuator and movement of the passively triggered actuator from the un-triggered position to the triggered position.

According to an embodiment of any paragraph(s) of this summary, the step of triggering the passively triggered actuator includes moving the passively triggered actuator from the un-triggered position to the triggered position by a force of an exhaust stream exiting an exhaust hole of the tactical flight vehicle.

According to an embodiment of any paragraph(s) of this summary, the step of triggering the passively triggered actuator includes moving the passively triggered actuator from the un-triggered position to the triggered position by a force of inertia of the tactical flight vehicle upon launch.

According to an embodiment of any paragraph(s) of this summary, the step of automatically moving the control surface restraint includes rotating a mounting ring around a longitudinal axis of the tactical flight vehicle from a first position to a second position.

According to an embodiment of any paragraph(s) of this summary, the step of automatically moving the control surface restraint further includes moving a rotation lock from a locked position in which the rotation lock is engaged with the mounting ring, to an unlocked position in which the rotation lock is disengaged with the mounting ring.

According to an embodiment of any paragraph(s) of this summary, the step of automatically moving the control surface restraint further includes sliding a disengagement abutment bar of the control surface restraint against an inclined portion of the mounting ring during the step of rotating the mounting ring such that the control surface restraint is automatically moved from the engaged position to the disengaged position.

According to an embodiment of any paragraph(s) of this summary, the method also includes the step of holding the control surface restraint in the disengaged position by fitting the disengagement abutment bar of the control surface restraint in a disengagement locking notch of the inclined portion of the mounting ring.

According to an embodiment of any paragraph(s) of this summary, the method also includes the step of manually moving the control surface restraint from the engaged position to the disengaged position.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

Figure 1:
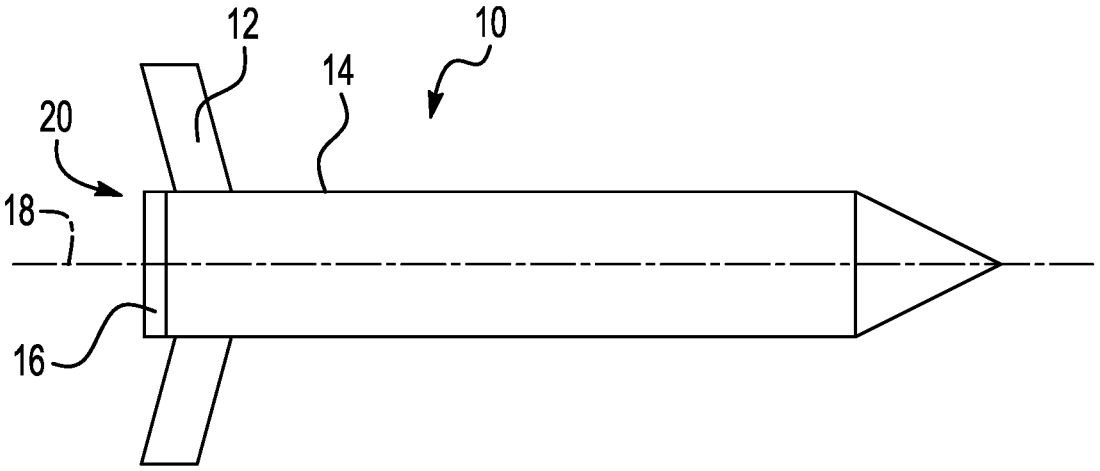
FIG. 1 is a schematic diagram of a tactical flight vehicle.

According to a general embodiment, a control surface restraining system for variably restraining a control surface on a tactical flight vehicle is described. With reference to FIG. 1, a general schematic of a tactical flight vehicle 10 is depicted. The tactical flight vehicle 10 may be, for example, a missile or a rocket. The tactical flight vehicle 10 includes at least one control surface 12 mounted to the tactical flight vehicle 10, for example on an airframe 14 of the tactical flight vehicle 10. In the embodiment shown and described herein, the at least one control surface 12 is a tail fin. It is understood however that aspects of this disclosure may be applicable to other types of control surfaces, such as elevators, ailerons, elevons, rudders, flaps, slats, etc. The tactical flight vehicle 10 includes a control surface restraining system 16 located at an aft end 20 of the tactical flight vehicle 10. The control surface restraining system 16 is configured to restrain the control surface 12 and maintain the control surface 12 in a "zero position" (i.e., aligned with a longitudinal axis 18 of the tactical flight vehicle 10) prior to launch of the tactical flight vehicle 10 and initialization of the control actuation system. The control surface restraining system 16 also allows for temporary manual rotation of the control surface 12 out of the "zero position" for handling and loading the tactical flight vehicle 10 into a carrying aircraft. Upon launch of the tactical flight vehicle 10, the control surface restraining system 16 is passively triggered, causing an automatic (i.e., requiring no active stimulus from the guidance section, power, or associated wiring) release of the control surface 12 such that the control actuation system can control the control surface 12 thereafter during flight of the tactical flight vehicle 10.

Figure 2:
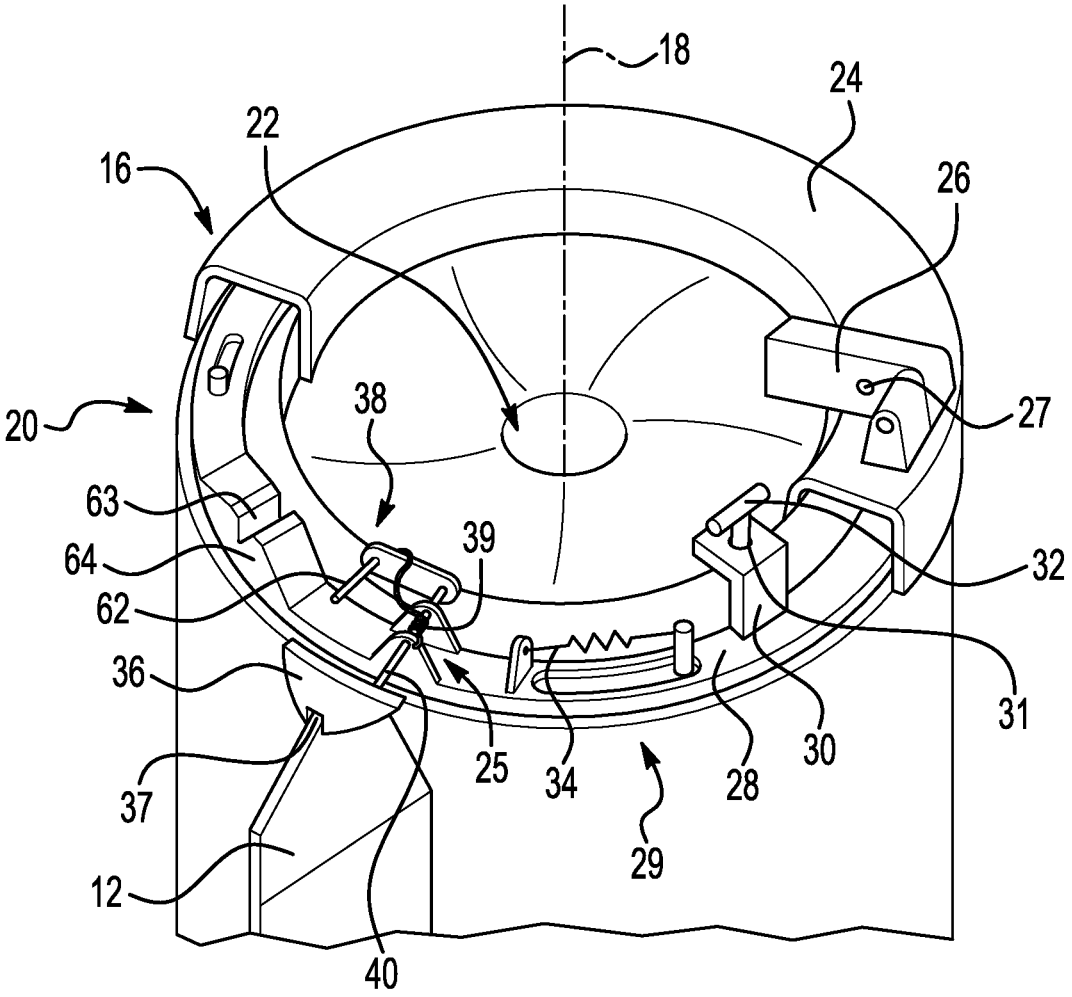
FIG. 2 is a partially cutaway schematic diagram of a control surface restraining system of the tactical flight vehicle of FIG. 1.

Now turning to FIG. 2, a first embodiment of the control surface restraining system 16 will be described in more detail. In the depicted embodiment, the control surface restraining system 16 surrounds an exhaust opening 22 of the tactical flight vehicle 10 about the longitudinal axis 18. Although only a single control surface restraining system 16 configured for a single control surface 12 is depicted, the depicted control surface restraining system 16 may be replicated for any number of associated control surfaces 12 on the tactical flight vehicle 10. For example, on a tactical flight vehicle 10 having four control surfaces 12, the depicted control surface restraining system 16 would be replicated four times around the exhaust opening 22, each control surface restraining system 16 corresponding to each control surface 12, respectively. The control surface restraining system 16 includes a cover 24 configured to house at least some components of the control surface restraining system 16. The cover 24 is depicted as partially cutaway in FIG. 2 to show the other components housed therein, which will be described in more detail below. Mounted on an exterior of the cover 24 is a passively triggered actuator 26 of the control surface restraining system 16. The passively triggered actuator 26 is moveable between an un-triggered position and a triggered position. When the passively triggered actuator 26 is in the un-triggered position, the control surface restraining system 16 is configured to restrain the control surface 12. For example, the passively triggered actuator 26 is configured to be in the un-triggered position before launch of the tactical flight vehicle 10 so that the control surface 12 is kept in alignment with the longitudinal axis 18 of the tactical flight vehicle 10 (in the "zero position") for proper control actuation system initialization upon launch. When the passively triggered actuator 26 is in the triggered position, the control surface restraining system 16 is configured to automatically release the control surface 12, as will be described in more detail below. For example, upon launch, the passively triggered actuator 26 is moved to the triggered position so that the control surface 12 is released and the control actuation system is able to control the control surface 12 for the duration of flight of the tactical flight vehicle.

In the depicted embodiment, the passively triggered actuator 26 is a tab, pivotally mounted to the cover 24 at a proximal end of the passively triggered actuator 26 and extending away from the cover 24 toward the longitudinal axis 18 of the tactical flight vehicle 10. With additional reference to FIG. 3, for example, the passively triggered actuator 26 may be a U-shaped tab including one or more pivot mounting holes 23 at the proximal end thereof for mounting the passively triggered actuator 26 to the exterior of the cover 24. It is understood, however, that the passively triggered actuator 26 may have another suitable shape. For example, as another non-limiting example, the passively triggered actuator 26 may be a generally flat tab. In the un-triggered position, the passively triggered actuator 26 is configured to extend generally perpendicular to the longitudinal axis 18 such that the distal end of the passively triggered actuator 26 is cantilevered over the exhaust opening 22 of the tactical flight vehicle 10. In this manner, the distal end of the passively triggered actuator 26 is acted on by an exhaust stream of the tactical flight vehicle 10 when the tactical flight vehicle 10 is launched. Accordingly, a force of the exhaust stream exiting the exhaust opening 22 causes the passively triggered actuator 26 to pivot to the triggered position in which the passively triggered actuator 26 is moved to be positioned at an angle relative to the longitudinal axis 18. Moving generally further away from the cover 24 in the triggered position relative to its position in the un-triggered position, the passively triggered actuator 26 initiates an automatic release of the control surface 12 by corresponding action of other components of the control surface restraining system 16, as will be described in more detail below.

Specifically, housed at least partially within the cover 24 is a control surface restraint 25, movable between an engaged position and a disengaged position, and a disengagement assembly 29 configured to automatically move the control surface restraint 25 from the engaged position to the disengaged position when the passively triggered actuator 26 is moved from the un-triggered position to the triggered position. The disengagement assembly 29 will first be described in detail herein, while the details of the control surface restraint 25 and the action of the disengagement assembly 29 on the control surface restraint 25 will thereafter be described in more detail.

Figure 3:
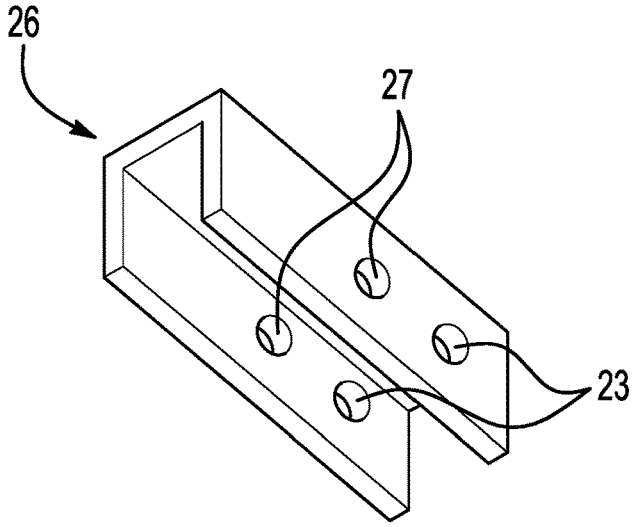
FIG. 3 is a perspective view of a passively triggered actuator in the control surface restraining system of FIG. 2.
Figure 4:
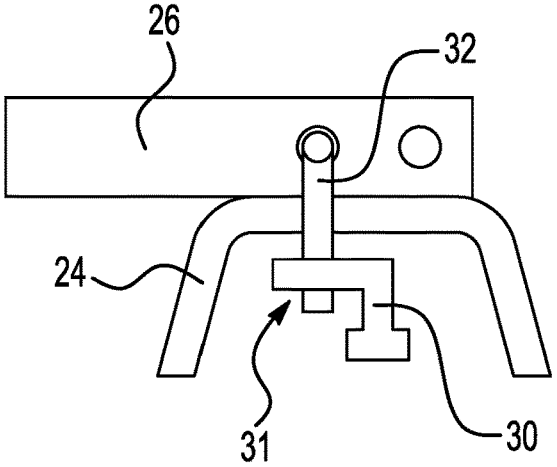
FIG. 4 is a cross-sectional diagram of a passively triggered actuator and rotation lock in the control surface restraining system of FIG. 2.

The disengagement assembly 29 includes an annular mounting ring 28 rotatable about the longitudinal axis 18 of the tactical flight vehicle 10 relative to the aft end 20 of the tactical flight vehicle 10 and the cover 24, between a first position and a second position. The mounting ring 28 includes an engagement hole 31 for engagement with a rotation lock 32. Although depicted as disconnected from the passively triggered actuator 26 for purposes of exploded illustration, the rotation lock 32 is configured to be mated with the passively triggered actuator 26 (for example, via a through hole 27 or other attachment means on the passively triggered actuator 26, as also depicted in FIG. 3) on an exterior of the cover 24. With additional reference to FIG. 4, the rotation lock 32 is configured to extend through the cover 24 so as to engage the engagement hole 31 of the mounting ring 28. As depicted in FIGS. 2 and 4, the engagement hole 31 may be provided in a rotation lock bracket 30 mounted on the mounting ring 28. Alternatively, however, the engagement hole 31 may be provided in the mounting ring 28, itself. The rotation lock 32 is moveable between a locked position, in which the rotation lock 32 is configured to engage the engagement hole 31, and an unlocked position, in which the rotation lock 32 is configured to be disengaged with the engagement hole 31. Movement of the passively triggered actuator 26 from the un-triggered position to the triggered position causes corresponding movement of the rotation lock 32 from the locked position to the unlocked position. That is, as the passively triggered actuator 26 moves away from the cover 24, it pulls the rotation lock 32 out of engagement with the engagement hole 31.

When the passively triggered actuator 26 is in the un-triggered position and the rotation lock 32 is in the locked position, the mounting ring 28 is held in the first position. The disengagement assembly 29 also includes a mounting ring biasing member 34 at least partially mounted on the mounting ring 28 and configured to bias the mounting ring 28 toward the second position. For example, a first end of the mounting ring biasing member 34 may be mounted to the mounting ring 28. A second end of the mounting ring biasing member 34 may be mounted to the aft end 20 of the tactical flight vehicle 10 through a sliding hole, with a biasing force extending between the first end and the second end. Accordingly, when the passively triggered actuator 26 moves from the un-triggered position to the triggered position and the rotation lock 32 moves from the locked position to the unlocked position, the mounting ring biasing member 34 causes the mounting ring 28 to rotate from the first position to the second position. The mounting ring biasing member 34 may be a torsion spring or a compression spring, for example. In FIG. 2, movement of the mounting ring 28 from the first position to the second position includes rotation of the mounting ring 28 in a counterclockwise direction.

Movement of the mounting ring 28 from the first position to the second position causes the disengagement assembly 29 to automatically move the control surface restraint 25 from the engaged position to the disengaged position. Specifically, the control surface restraint 25 includes a control surface engagement portion 36 configured to engage the edge of the control surface 12 when the control surface restraint 25 is in the engaged position, and a control surface restraining portion 38 fixed to the control surface engagement portion 36. The control surface engagement portion 36 and the control surface restraining portion 38 are mounted to the aft end 20 of the tactical flight vehicle 10, not to the mounting ring 28, such that the control surface restraint 25 does not move along with the mounting ring 28 as the mounting ring 28 rotates from the first position to the second position. The control surface engagement portion 36 is configured to extend out of the cover 24 so that it engages the control surface 12. For example, the control surface engagement portion 36 may include a notch 37 configured to engage the edge of the control surface 12. In another embodiment, the control surface engagement portion 36 may include a pin configured to fit into a hole in the edge of the control surface 12.

The control surface restraining portion 38 is at least partially housed within the cover 24 so as to interact with the disengagement assembly 29 therein. The control surface restraining portion 38 includes a control surface support bar 40 configured to extend out of the cover 24 to support the control surface engagement portion 36 and a disengagement abutment bar 62 configured to interact with the disengagement assembly 29 within the cover 24. Specifically, the disengagement abutment bar 62 of the control surface restraining portion 38 is configured to abut and slide against an inclined portion 64 of the mounting ring 28 of the disengagement assembly 29 as the mounting ring 28 rotates from the first position to the second position. In doing so, the control surface restraint 25 automatically moves from the engaged position to the disengaged position as the control surface restraining portion 38 pivots, causing the control surface engagement portion 36 to pivot out of engagement with the control surface 12.

The control surface restraining portion 38 may include a restraining biasing member 39 configured to bias the control surface restraint 25 in the engaged position (i.e., the control surface engagement portion 36 in engagement with the edge of the control surface 12). The restraining biasing member 39 may be, for example, a torsion spring. As another non-limiting example, the restraining biasing member 39 may be a compression spring disposed between the housing 16 and the control surface restraining portion 38. As the inclined portion 64 of the mounting ring 28 causes the disengagement abutment bar 62 to pivot, a force of the restraining biasing member 39 is overcome such that the control surface restraint 25 can move from the engaged position to the disengaged position. The inclined portion 64 of the mounting ring 28 may include a disengagement locking notch 63 into which the disengagement abutment bar 62 of the control surface restraining portion 38 is configured to fit when the disengagement abutment bar 62 slides up the inclined portion 64. The disengagement locking notch 63 is configured to hold the control surface restraint 25 in the disengaged position for the duration of flight after launch of the tactical flight vehicle 10, such that the control actuation system is free to control the control surface 12 thereafter. The disengagement abutment bar 62 may be released out of the disengagement locking notch 63 with special tooling in order to rotate the mounting ring 28 back to the first position.

The force of the restraining biasing member 39 can also be overcome manually, such that the control surface restraint 25 may be manually moved from the engaged position to the disengaged position without triggering the passively triggered actuator 26 or causing movement of the mounting ring 28. For example, when handling or loading the tactical flight vehicle 10 into a carrying aircraft prior to launch, it may be necessary or desirable to temporarily rotate the control surface 12 out of alignment with the longitudinal axis 18. Therefore, a user may apply a manual force sufficient to overcome the force of the restraining biasing member 39 to manually move the control surface restraint 25 from the engaged position to the disengaged position. With the control surface restraint 25 in the disengaged position, the user is free to rotate the control surface 12 out of alignment with the longitudinal axis 18, for example to make room for a common loading strap to be wrapped around the tactical flight vehicle 10. Upon removal of the manual force, the control surface restraint 25 returns to the engaged position by action of the restraining biasing member 39. When a user desires to return and maintain the control surface 12 back in alignment with the longitudinal axis 18, the user may simply apply the manual force to the control surface restraint 25 to move the control surface 12 from the engaged position to the disengaged position, rotate the control surface 12 back into alignment with the longitudinal axis, and remove the manual force such that the restraining biasing member 39 causes the control surface restraint 25 to return to the engaged position and the control surface restraint 25 engages the control surface 12 again.

Figure 5:
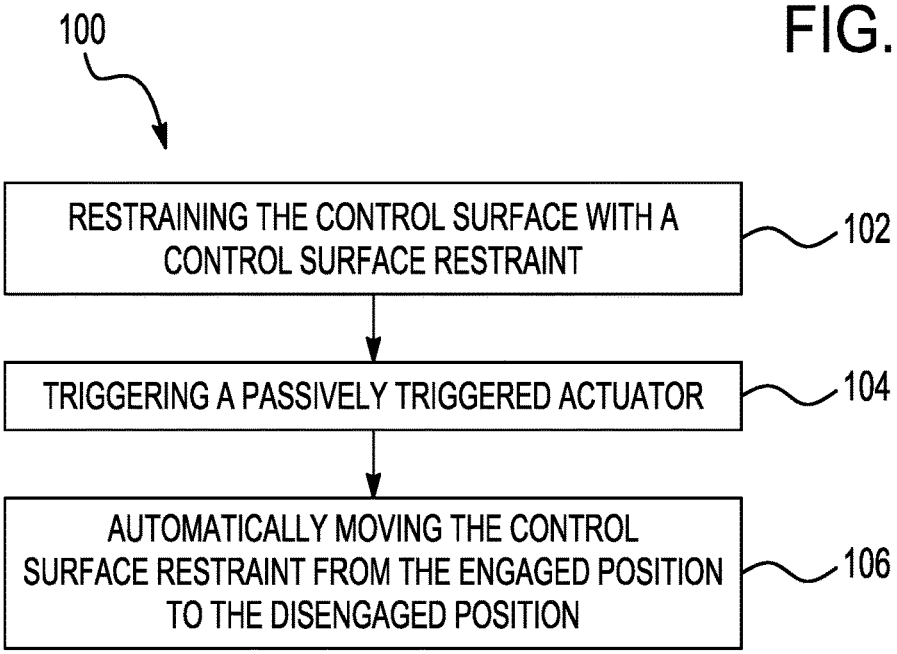
FIG. 5 is a flowchart of a method of variably restraining a control surface on a tactical flight vehicle.

A method 100 of variably restraining a control surface on a tactical flight vehicle will now be described with reference to FIG. 5. The tactical flight vehicle, for example, may be the tactical flight vehicle 10 (FIG. 1) described herein, having the control surface restraining system 16 (FIGS. 1-3) previously described. Therefore, the method 100 includes a step 102 of restraining the control surface with a control surface restraint. The control surface restraint, for example, may be the same as the control surface restraint 25 (FIG. 2) described herein. The control surface restraint, therefore, is moveable between an engaged position, in which the control surface restraint is engaged with the control surface, and a disengaged position, in which the control surface restraint is disengaged with the control surface. The method 100 may include a step of manually moving the control surface restraint from the engaged position to the disengaged position. For example, a manual force may be applied to overcome a restraining biasing member, such as the restraining biasing member 39 (FIG. 2) described herein, that is configured to bias the control surface restraint in the engaged position. Upon removal of such manual force, the restraining biasing member causes the control surface restraint to return to the engaged position to restrain the control surface.

The method 100 further includes a step 104 of triggering a passively triggered actuator such that the passively triggered actuator is moved from an un-triggered position to a triggered position. The passively triggered actuator may be the same as the passively triggered actuator (FIGS. 2 and 3) described herein. Therefore, for example, the step 104 of triggering the passively triggered actuator may include moving the passively triggered actuator from the un-triggered position to the triggered position by a force of an exhaust stream exiting an exhaust hole of the tactical flight vehicle, as previously described. In an alternative embodiment, the step 104 of triggering the passively triggered actuator may include moving the passively triggered actuator from the un-triggered position to the triggered position by a force of inertia of the tactical flight vehicle upon launch.

Upon the step 104 of triggering the passively triggered actuator, and thus moving the passively triggered actuator from the un-triggered position to the triggered position, the method 100 then includes a step 106 of automatically moving the control surface restraint from the engaged position to the disengaged position. The step 106 of automatically moving the control surface restraint may be performed by action of a disengagement assembly similar to the disengagement assembly 29 (FIG. 2) described herein. Specifically, therefore, the step 106 of automatically moving the control surface restraint may include rotating a mounting ring around a longitudinal axis of the tactical flight vehicle from a first position to a second position. The mounting ring may be the same as the mounting ring 28 (FIG. 2) described herein. The step 106 of automatically moving the control surface restraint may also therefore include moving a rotation lock from a locked position in which the rotation lock is engaged with the mounting ring, to an unlocked position in which the rotation lock is disengaged with the mounting ring, such that the mounting ring can rotate. The rotation lock may be the same as the rotation lock 32 (FIG. 2) described herein and therefore be configured to operate in the same way as previously described. Furthermore, the step 106 of automatically moving the control surface restraint may also include sliding a disengagement abutment bar of the control surface restraint, such as the disengagement abutment bar 62 (FIG. 2) described herein, against an inclined portion of the mounting ring, such as the inclined portion 64 (FIG. 2) described herein, during the step of rotating the mounting ring. In this manner, the control surface restraint is automatically moved from the engaged position to the disengaged position, as described above.

The method 100 may additionally include the step of holding the control surface restraint in the disengaged position by fitting the disengagement abutment bar of the control surface restraint in a disengagement locking notch of the inclined portion of the mounting ring. The disengagement locking notch may be the same as the disengagement locking notch 63 (FIG. 2) described herein and may therefore be configured to operate in the same manner.

Figure 6:
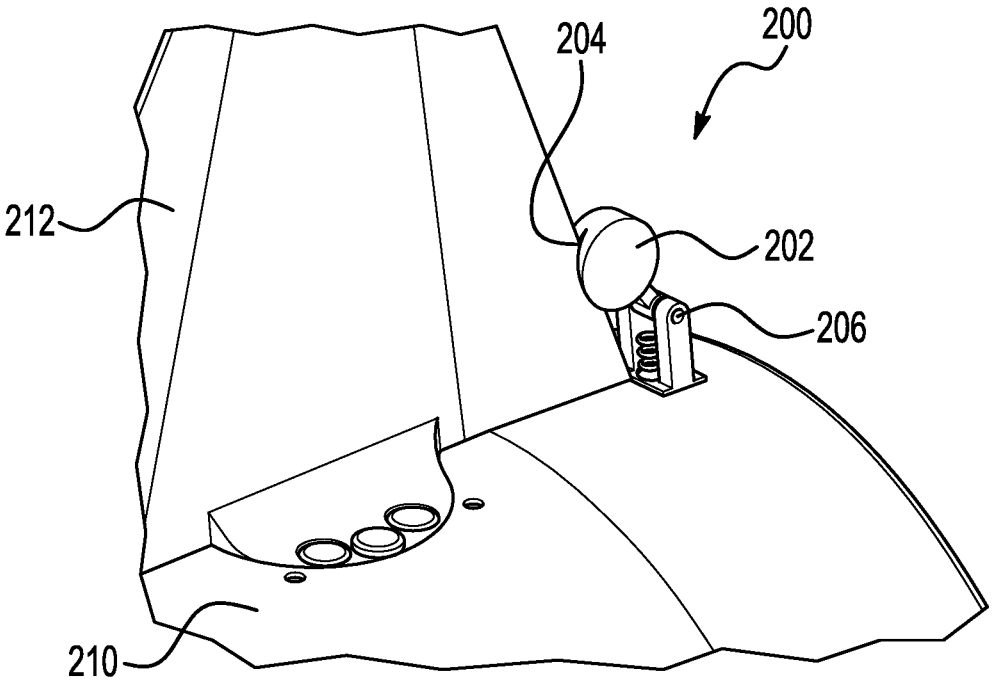
FIG. 6 is a perspective view of another control surface restraining system of the tactical flight vehicle of FIG. 1.
Figure 7:
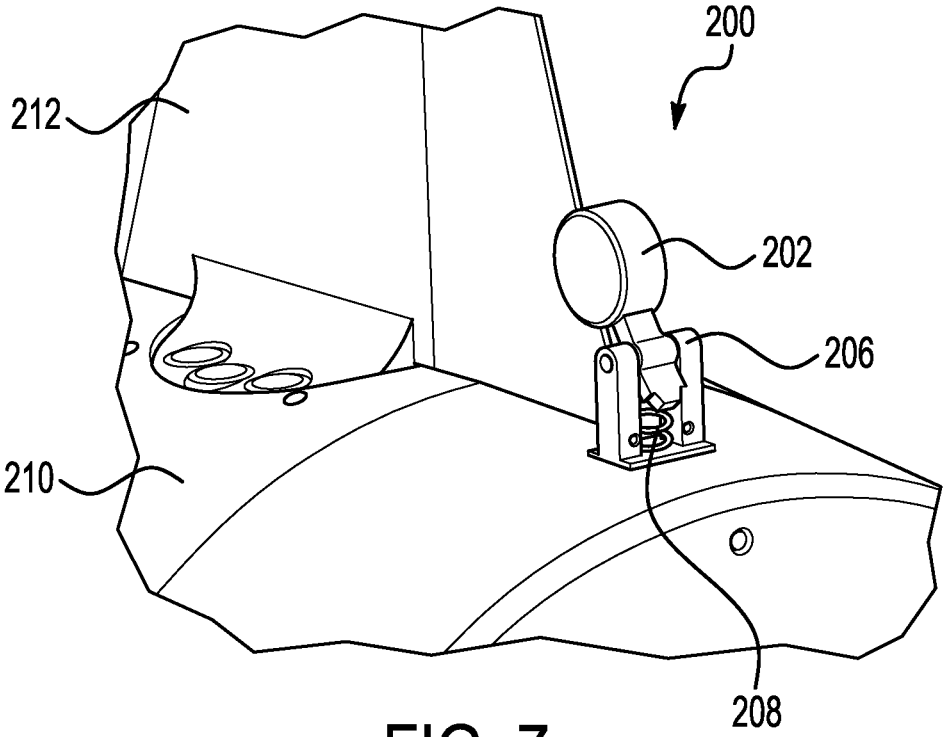
FIG. 7 is another perspective view of the control surface restraining system of FIG. 6.

Turning to FIGS. 6 and 7, another embodiment of a control surface restraining system 200 for variably restraining the control surface 212 of the tactical flight vehicle 210 will be described. In this embodiment, the control surface restraining system 200 includes a passively triggered actuator 202 in the form of a displacement mass (for example, in the shape of a disc), a control surface restraint 204 in the form of an engagement notch in the disc, and a disengagement assembly 206 in the form of a pivoting mount of the disc. The passively triggered actuator 202 is configured to be moved from the untriggered position to the triggered position by a force of inertia upon launch of the tactical flight vehicle 210. In the untriggered position of the passively triggered actuator 202, the control surface restraint 204 is in the engaged position and the edge of the control surface 212 is fit within the engagement notch of the control surface restraint 204. In the triggered position of the passively triggered actuator 202, the control surface restraint 204 is in the disengaged position and the edge of the control surface 212 is free from the engagement notch of the control surface restraint 204. The disengagement assembly 206 is configured to allow the pivoting of both the passively triggered actuator 202 and, thus, the consequential pivoting of the control surface restraint 204.

Specifically, upon launch, the force of inertia moves the passively triggered actuator 202 from the untriggered position to the triggered position, by way of the disengagement assembly 206 which is also configured to thereby move the control surface restraint 204 from the engaged position to the disengaged position. The control surface restraining system 200 according to this embodiment also includes a control surface engagement biasing member 208 configured to bias the passively triggered actuator 202 in the untriggered position and the control surface restraint 204 in the engaged position. The force of inertia upon launch of the tactical flight vehicle 10 is able to overcome a force of the control surface engagement biasing member 208 such that the passively triggered actuator 202 is moved from the untriggered position to the triggered position and the control surface restraint 204 is moved from the engaged position to the disengaged position. Additionally, a manual force may be applied to the passively triggered actuator 202 and control surface restraint 204 to overcome the force of the control surface engagement biasing member 208 such that a user may manually move the control surface restraint 204 from the engaged position to the disengaged position prior to launch of the tactical flight vehicle 210 and free up the control surface 212 for rotation prior to launch and control actuation system initialization.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. A control surface restraining system for restraining a control surface on a tactical flight vehicle, the control surface restraining system comprising:

a passively triggered actuator movable between an un-triggered position and a triggered position;

a control surface restraint movable between an engaged position and a disengaged position, the control surface restraint being biased in the engaged position; and a disengagement assembly configured to automatically move the control surface restraint from the engaged position to the disengaged position when the passively triggered actuator is moved from the un-triggered position to the triggered position.

2. The control surface restraining system according to claim 1, wherein the disengagement assembly includes:

a mounting ring rotatable around a longitudinal axis of the tactical flight vehicle between a first position and a second position;

a rotation lock fixed to and movable by the passively triggered actuator, the rotation lock being movable between a locked position in which the rotation lock is configured to be engaged with the mounting ring and an unlocked position in which the rotation lock is configured to be disengaged with the mounting ring, wherein the rotation lock is configured to hold the mounting ring in the first position when the rotation lock is in the locked position; and a mounting ring biasing member at least partially mounted on the mounting ring and configured to bias the mounting ring toward the second position such that the mounting ring is configured to rotate from the first position to the second position when the rotation lock is in the unlocked position.

3. The control surface restraining system according to claim 1, wherein the control surface restraint includes:

a control surface engagement portion configured to engage an edge of the control surface when the control surface restraint is in the engaged position; and a control surface restraining portion fixed to the control surface engagement portion and configured to interact with the disengagement assembly to move the control surface restraint from the engaged position to the disengaged position.

4. The control surface restraining system according to claim 3, wherein the control surface restraining portion includes:

a control surface support bar configured to support the control surface engagement portion; and a disengagement abutment bar configured to interact with the disengagement assembly.

5. The control surface restraining system according to claim 4, wherein the mounting ring of the disengagement assembly includes an inclined portion and the disengagement abutment bar of the control surface restraining portion is configured to abut and slide against the inclined portion of the mounting ring as the mounting ring rotates from the first position to the second position, causing the control surface restraint to automatically move from the engaged position to the disengaged position.

6. The control surface restraining system according to claim 5, wherein the inclined portion of the mounting ring includes a disengagement locking notch into which the disengagement abutment bar of the control surface restraining portion is configured to fit when the disengagement abutment bar slides up the inclined portion.

7. The control surface restraining system according to claim 3, wherein the control surface engagement portion includes a notch configured to engage the edge of the control surface.

8. The control surface restraining system according to claim 3, wherein the control surface engagement portion includes a pin configured to fit into a pinhole in an edge of a missile fin.

9. The control surface restraining system according to claim 1, wherein the passively triggered actuator is a tab extending into an exhaust stream of the tactical flight vehicle, wherein the passively triggered actuator is moved from the un-triggered position to the triggered position with a force of the exhaust stream.

10. The control surface restraining system according to claim 1, wherein the control surface restraint includes a restraining biasing member configured to bias the control surface restraint in the engaged position.

11. The control surface restraining system according to claim 1, wherein the control surface restraint is configured to be manually movable from the engaged position to the disengaged position when the passively triggered actuator is in the un-triggered position.

12. The control surface restraining system according to claim 1, further comprising a cover configured to house at least part of the control surface restraint and the disengagement assembly.

13. A tactical flight vehicle, comprising:

an airframe extending along a longitudinal axis;

at least one control surface mounted to an aft end of the airframe; and at least one control surface restraining system according to claim 1, for restraining the at least one control surface on the tactical flight vehicle.

14. A method of variably restraining a control surface on a tactical flight vehicle, the method comprising the steps of:

restraining the control surface with a control surface restraint, the control surface restraint being movable between an engaged position and a disengaged position;

triggering a passively triggered actuator such that the passively triggered actuator is moved from an un-triggered position to a triggered position; and automatically moving the control surface restraint from the engaged position to the disengaged position upon the triggering of the passively triggered actuator and movement of the passively triggered actuator from the un-triggered position to the triggered position.

15. The method according to claim 14, wherein the step of triggering the passively triggered actuator includes moving the passively triggered actuator from the un-triggered position to the triggered position by a force of an exhaust stream exiting an exhaust hole of the tactical flight vehicle.

16. The method according to claim 1, wherein the step of automatically moving the control surface restraint includes rotating a mounting ring around a longitudinal axis of the tactical flight vehicle from a first position to a second position.

17. The method according to claim 16, wherein the step of automatically moving the control surface restraint further includes moving a rotation lock from a locked position in which the rotation lock is engaged with the mounting ring, to an unlocked position in which the rotation lock is disengaged with the mounting ring.

18. The method according to claim 16, wherein the step of automatically moving the control surface restraint further includes sliding a disengagement abutment bar of the control surface restraint against an inclined portion of the mounting ring during the step of rotating the mounting ring such that the control surface restraint is automatically moved from the engaged position to the disengaged position.

19. The method according to claim 18, further comprising the step of holding the control surface restraint in the disengaged position by fitting the disengagement abutment bar of the control surface restraint in a disengagement locking notch of the inclined portion of the mounting ring.

20. The method according to claim 14, further comprising the step of manually moving the control surface restraint from the engaged position to the disengaged position.

* * * * *